US009057527B2

(12) United States Patent
Oagley et al.

(10) Patent No.: US 9,057,527 B2
(45) Date of Patent: Jun. 16, 2015

(54) RANGE HOOD APPLIANCE WITH COMBINATION RECIRCULATION AND EXTERIOR VENTING OPTIONS

(75) Inventors: Howard James Oagley, Louisville, KY (US); Mark Davis Johnson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 341 days.

(21) Appl. No.: 13/417,639

(22) Filed: Mar. 12, 2012

(65) Prior Publication Data

US 2013/0233295 A1 Sep. 12, 2013

(51) Int. Cl.
*F24C 15/20* (2006.01)

(52) U.S. Cl.
CPC ..... *F24C 15/20* (2013.01)

(58) Field of Classification Search
USPC ..... 55/422
See application file for complete search history.

(56) References Cited

U.S. PATENT DOCUMENTS

| | | | | | |
|---|---|---|---|---|---|
| 2,820,513 | A * | 1/1958 | Drakoff | 55/422 |
| 3,125,869 | A * | 3/1964 | Winton | 62/317 |
| 3,299,463 | A * | 1/1967 | McEachern | 15/312.2 |
| 3,884,668 | A * | 5/1975 | Suzuki et al. | 65/142 |
| 3,965,886 | A * | 6/1976 | Nelson | 126/521 |
| 4,133,300 | A * | 1/1979 | Burton et al. | 126/299 D |
| 4,146,016 | A * | 3/1979 | Bowen et al. | 126/299 D |
| 4,247,370 | A * | 1/1981 | Nijhawan et al. | 202/263 |
| 4,266,528 | A * | 5/1981 | Barnhart et al. | 126/299 D |
| 4,512,787 | A * | 4/1985 | Mathews | 55/284 |
| 4,783,048 | A * | 11/1988 | St. Clair | 251/129.11 |
| 5,005,523 | A * | 4/1991 | Foster | 119/319 |
| 6,223,741 | B1 * | 5/2001 | Panos | 126/299 E |
| 6,227,962 | B1 * | 5/2001 | Orendorff | 454/290 |
| 6,626,972 | B2 * | 9/2003 | Chiang et al. | 55/418 |
| 6,720,543 | B2 * | 4/2004 | Yang | 219/757 |
| 6,820,609 | B2 * | 11/2004 | Woodall et al. | 126/299 R |
| 7,266,971 | B2 * | 9/2007 | Kang | 62/317 |
| 2002/0157661 | A1 * | 10/2002 | Kornberger | 126/301 |
| 2006/0003686 | A1 * | 1/2006 | Yamauchi | 454/234 |
| 2010/0012110 | A1 * | 1/2010 | Feisthammel et al. | 126/299 D |
| 2010/0089240 | A1 * | 4/2010 | Krichtafovitch | 96/32 |

* cited by examiner

*Primary Examiner* — Steven B McAllister
*Assistant Examiner* — Rabeeul Zuberi
(74) *Attorney, Agent, or Firm* — Dority & Manning, P.A.

(57) ABSTRACT

A range hood is provided that allows the user to select between venting to the exterior of a kitchen space versus recirculating air that is drawn over e.g., a cook top. Features are provided whereby the user can readily switch between such options for gas flow. A filter can also be provided whereby the user can readily select between different filter media depending upon the mode of gas flow selected.

19 Claims, 9 Drawing Sheets

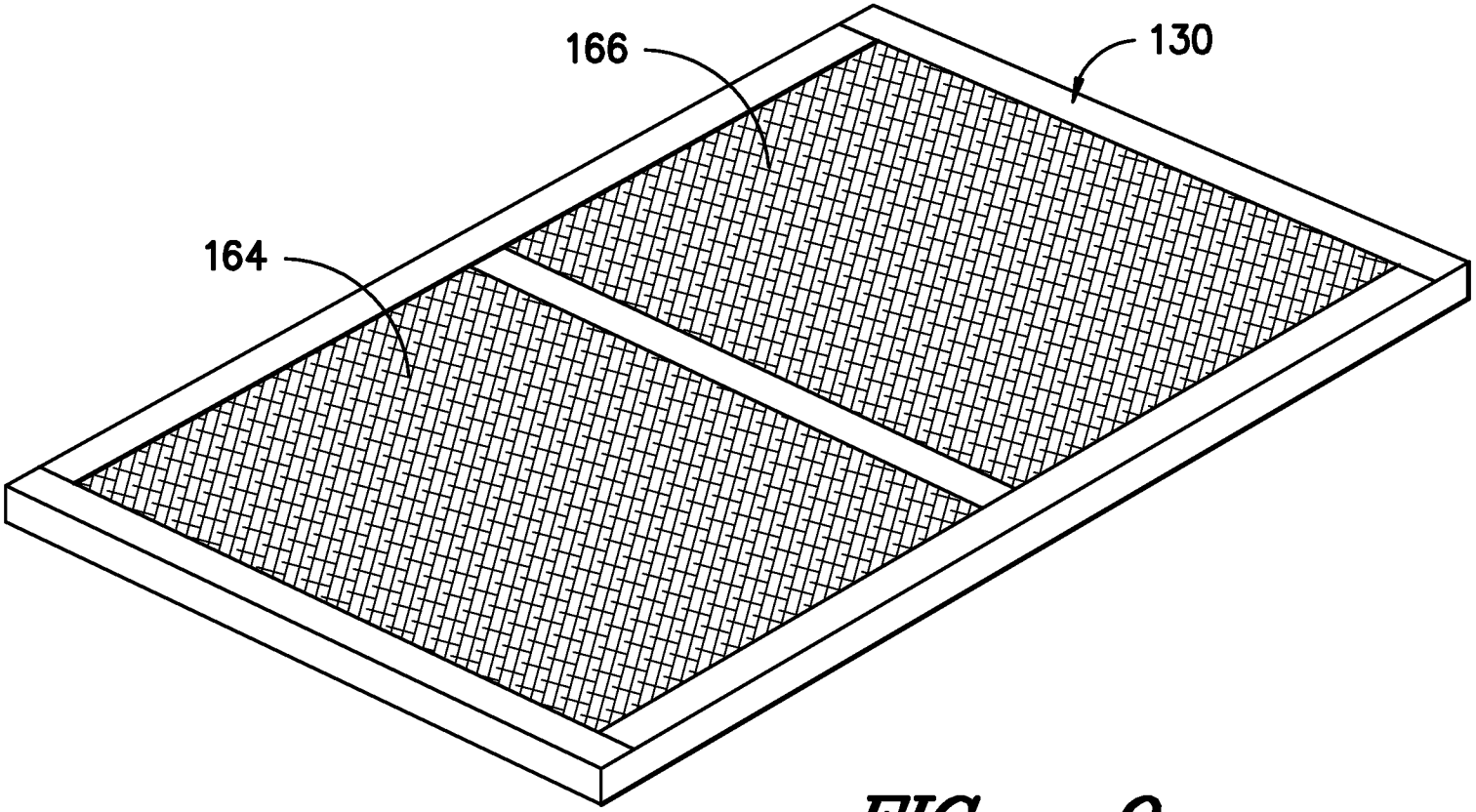
FIG. —9—

RANGE HOOD APPLIANCE WITH COMBINATION RECIRCULATION AND EXTERIOR VENTING OPTIONS

FIELD OF THE INVENTION

The subject matter of the present invention relates generally to a range hood that provides for recirculation and venting.

BACKGROUND OF THE INVENTION

Range hoods for kitchen areas are used to provide for air flow across a range or cooking surface in order to remove heat and/or fumes. Typically, such hoods may include one or more fans within a duct chamber placed over the range to receive air and fumes from the range and other parts of the kitchen area. The fan draws air up into the duct which in turn carries the fumes away from the range and draws more air across the cooking surface. Controls may be placed on the range hood, range, a remote control or any combination thereof depending upon the features provided.

Building codes or guidelines may set forth a certain minimum amount of air that must be moved by the range hood during use of the range. Such amounts are typically based on maximum use scenarios that assume e.g., full heat output by the range and/or other cooking appliances that may be present in the kitchen. These requirements can operate to provide reasonable temperatures within the kitchen area while preventing an undesirable buildup of fumes—particularly smoke or haze—within the kitchen area.

However, depending upon e.g., the amount and nature of heat and fumes produced by the range or other kitchen appliances, it may be desirable to recirculate back into the kitchen all or some portion of the air drawn into the hood. For example, during operation where smoke or fumes are minimal, the recirculation of the air may be preferable to exhausting the same to the atmosphere. Exhausting air to the atmosphere from a kitchen area will draw additional air into the kitchen that eventually must come from outside the structure or dwelling containing the kitchen area. Air from the outside may need to be heated or cooled by an air-conditioning system depending e.g., upon outside air temperature, which in turn consumes additional energy and provides added expense. Accordingly, for certain cooking situations, recirculation of air into the kitchen may be very desirable.

Certain range hoods have been provided that provide for recirculation only. While such designs may avoid the problems associated with drawing air from the exterior into the kitchen, as stated above, there can be times where the ability to draw fresh air from outside the kitchen is desirable or even required. Conversely, certain range hoods have been provided that provide only for drawing air from the exterior without a recirculation option, which can be undesirable where recirculation to the kitchen is preferable for reasons such as those described above. As a further complication, for certain kitchen applications, it may be preferable to filter the air using different filter media depending upon whether the range hood is venting to the exterior or recirculating.

Accordingly, a range hood that provides for both exterior venting or recirculation of air from a kitchen area would be useful. Such a range hood that allows the user to switch readily between recirculation and exterior venting without the use of tools or the permanent installation or removal of special parts would be beneficial. Additionally, such a range hood that also provide for the use of different filter media depending upon the mode of operation of the range hood would also be very useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a range hood appliance that includes a cabinet and a duct connected with the cabinet. The duct includes a gas inlet for the receipt of gas from a cooking space, a first gas outlet for directing gas to an exterior of the cooking space, and a second gas outlet for recirculating gas to the cooking space. A fan is provided for moving gas through the duct. A slidable plate is positioned at the first gas outlet. The slidable plate is configured for sliding along the cabinet between a closed position blocking the flow of gas from exiting through the first gas outlet and an open position adjacent to the first gas outlet that allows the flow of gas through the first gas outlet. A movable damper is positioned within the duct. The damper is movable between a closed position blocking the flow of gas through the second gas outlet and an open position that allows the flow of gas through the second gas outlet.

In another exemplary embodiment, the present invention provides a range hood appliance that includes an enclosure that having a top panel extending between two side panels and a rear panel also extending between the two side panels. A duct is defined at least partially within the enclosure. The duct connects a gas inlet, a first gas outlet leading to an exterior of a kitchen space, and a second gas outlet leading to the kitchen space. A blower is positioned at the gas inlet for drawing gas into the duct from the kitchen space. A gas flow controller is positioned within the duct and is configured for selectively allowing or blocking the flow of gas from the duct to the second gas outlet. A movable gate is positioned at the first gas outlet. The movable gate is configured for selective movement between a closed position that blocks the flow of gas from the duct through the first gas outlet and an open position that allows the flow of gas through the first gas outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 9 is a perspective view of an exemplary embodiment of a filter as may be used with the present invention.

DETAILED DESCRIPTION OF THE INVENTION

Figure 1:
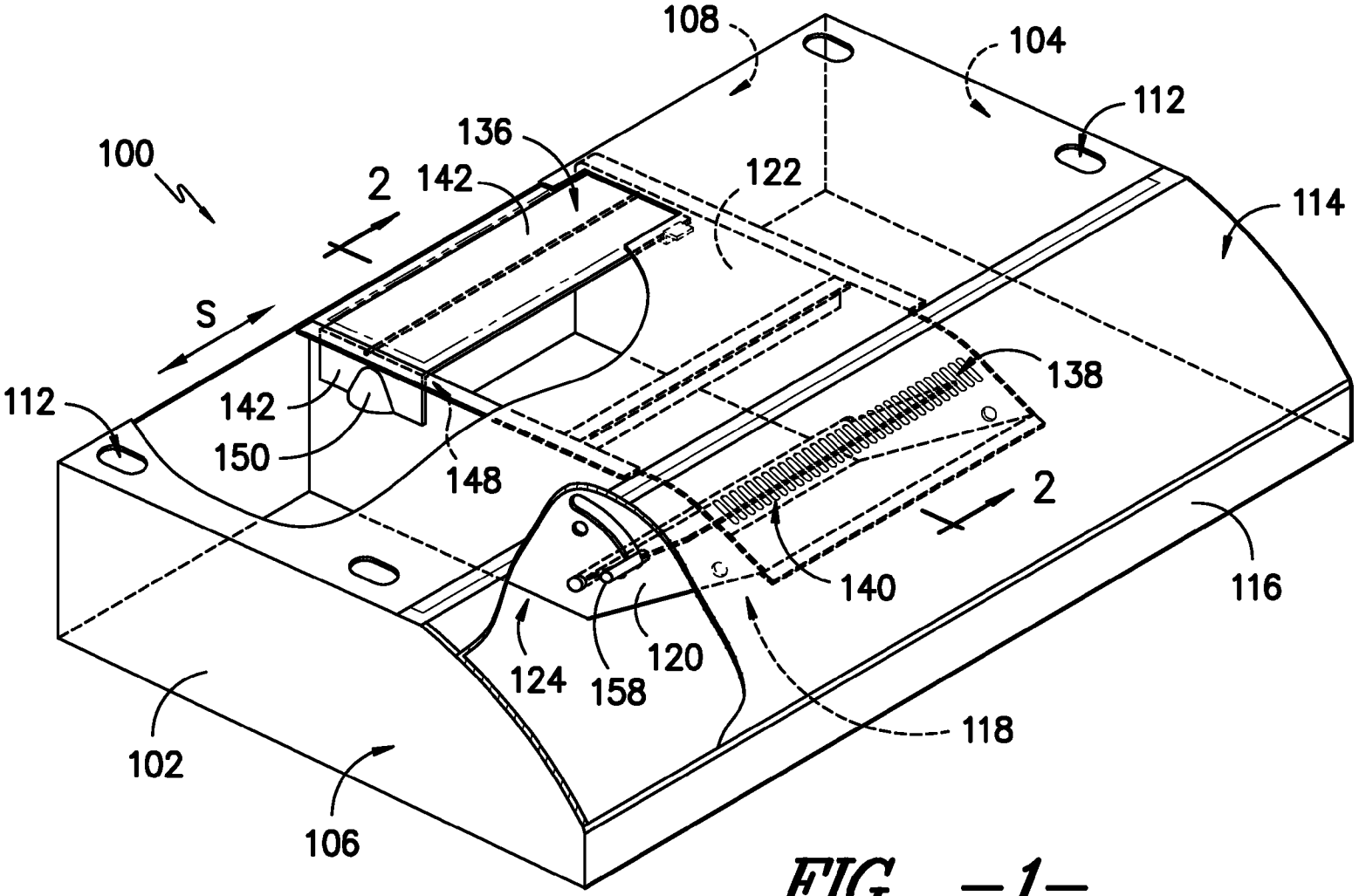
FIG. 1 provides a perspective and partial cross-sectional view of an exemplary embodiment of a range hood of the present invention with a first gas outlet closed.

The present invention provides a range hood that allows the user to select between venting to the exterior of a kitchen space or recirculating air. The range hood pulls in air and cooking from fumes from e.g., a cook top or range and includes features whereby the user can readily switch between exterior venting or recirculation. A filter can also be provided whereby the user can readily select between different filter media depending upon the mode of gas flow selected. Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective and partial cross-sectional view of an exemplary embodiment of a range hood 100 of the present invention. Range hood 100 can be mounted e.g., over a range or cook top appliance (not shown) in a kitchen or other cooking space. Range hood 100 can be operated to pull in gas that includes air from over the cooking appliance as well as the heat and cooking fumes associated with cooking operations. After filtering and depending upon the mode of operation selected by the user, range hood 100 can either exhaust such gas to the exterior (e.g., to the atmosphere) or recirculate such gas back into the kitchen.

The enclosure or cabinet 102 of range hood 100 includes side panels 104 and 106. Rear panel 108, top panel 110, front panel 114, and front face 116 extends between sides panels 104 and 106. Although not shown, front panel 114 and/or front face 116 can also be provided with controls to operate one or more fans, lights, and other features that may be included with range hood 100. A plurality of apertures 112 spaced about top panel 110 may be used to mount range hood 100 into e.g., cabinetry or other structure so as to suspend hood 100 over a cooking appliance. As will be understood by one of ordinary skill in the art using the teachings disclosed herein, the range hood of the present invention is not limited to the particular shape or configuration shown in FIG. 1 and, instead, other shapes and configurations may be used as well.

Range hood 100 also includes a duct 118 contained at least partially within cabinet 102. Duct 118 is defined in part by side walls 120 and 122 and a portion of top panel 110. Duct 118 channels the flow of air that is drawn into range hood 100.

Figure 2:
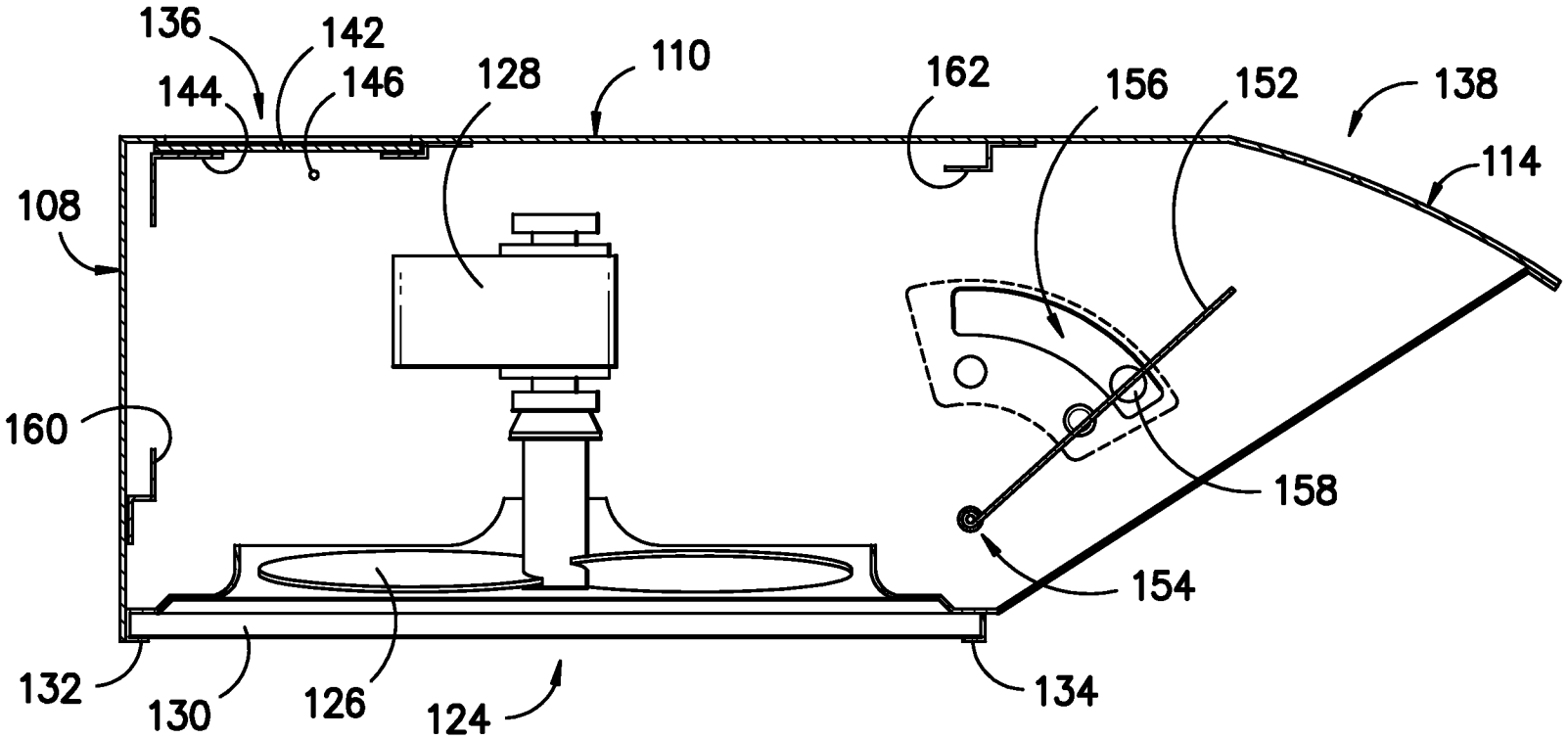
FIG. 2 is a side view of the exemplary range hood of FIG. 1 with a movable damper shown in the open position.

FIG. 2 provides a side, cross-sectional view of range hood 100 taken within duct 118 along line 2-2 in FIG. 1. As shown, duct 118 includes a gas inlet 124 where gas may be drawn into duct 118 by operation of a blower or fan 126 driven by motor 128. The gas is drawn through a filter 130 that is supported by, and can be slid along, guides 132 and 134. Gas moves through duct 118 and can exit through either first gas outlet 136 or second gas outlet 138 depending upon the positioning of other features as will be further described.

Figure 3:
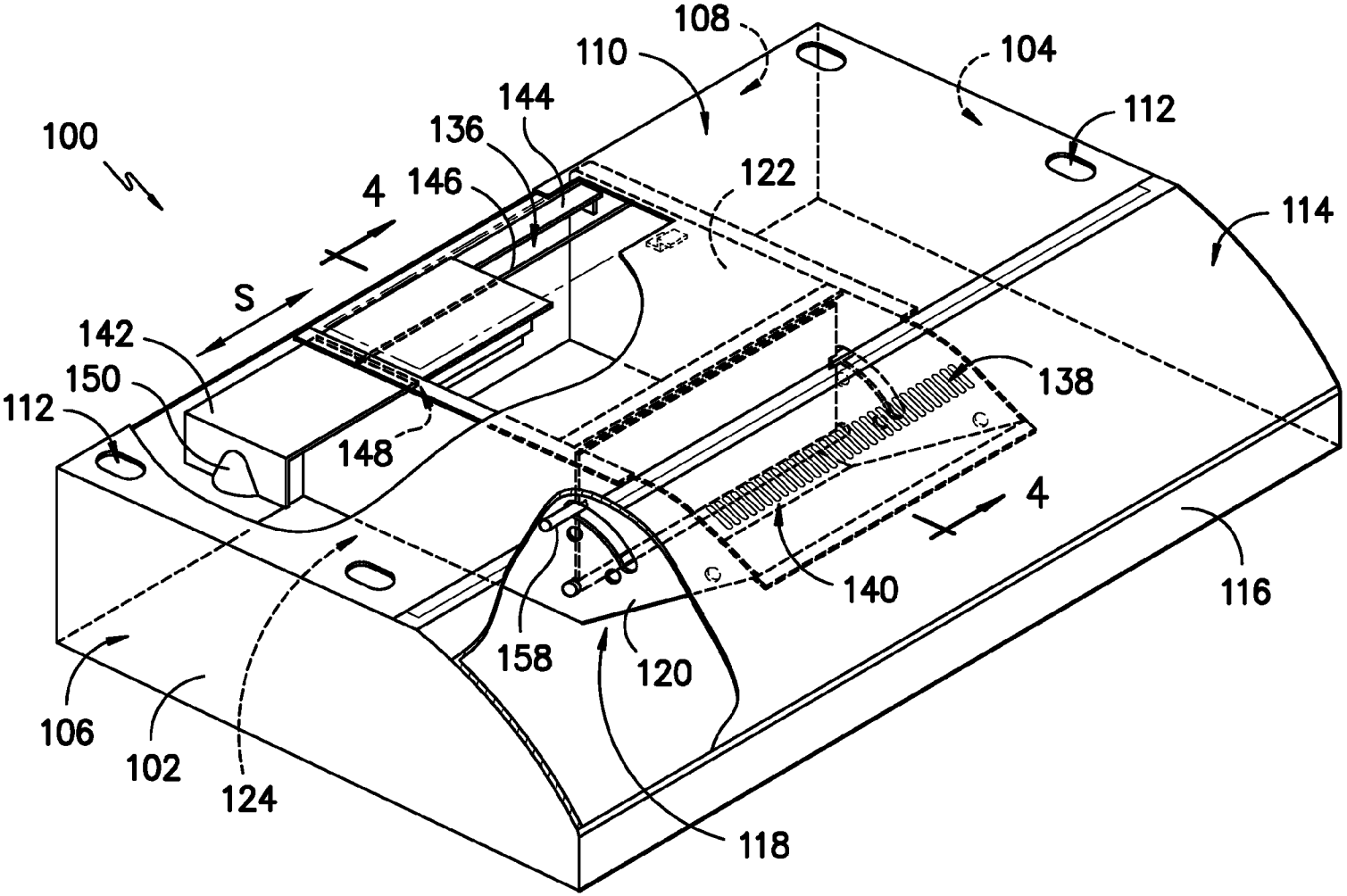
FIG. 3 is a perspective and partial cross-sectional view of the exemplary embodiment of a range hood of FIG. 1 with the first gas outlet open.

As shown in FIG. 1, for the exemplary embodiment, first gas outlet 136 is defined along top panel 110 and is rectangular in shape. Second gas outlet 138 is defined as a plurality of apertures 140 positioned along front panel 114. A movable plate 142 is slidable along a first rail 144 and a second rail 146. As illustrated by arrows S in FIG. 1, using the handle 150 on plate 142, a user can readily cause plate 142 to be inserted into, or withdrawn from, duct 118 through a slot 148 defined in side wall 120. In FIG. 1, plate 142 is shown in a closed position where plate 142 blocks the flow of gas from exiting through first gas outlet 136 when fan 126 is operated to draw gas into duct 118. Conversely, as shown in FIG. 3, plate 142 can be moved to an open position by withdrawing plate 142 through slot 148 so as to allow gas to flow from duct 118 and exit through first gas outlet 136.

Referring now to FIGS. 1 through 4, a movable damper 152 acting as a gas flow controller is provided within duct 118 and is movable between a closed position blocking the flow of gas from exiting duct 118 through second gas outlet 138 (FIG. 4) and an open position allowing the flow of gas to exit duct 118 through second gas outlet 138 (FIG. 2). For this exemplary embodiment, damper 152 is pivotable or rotatable about pivot point 154. Side wall 120 defines an aperture 156 through which a pin or handle 158 extends and is connected to damper 152. Handle 158 is readily accessible and allows the user to position damper 152 between the open position shown in FIG. 2 and the closed position shown in FIG. 4.

Figure 4:
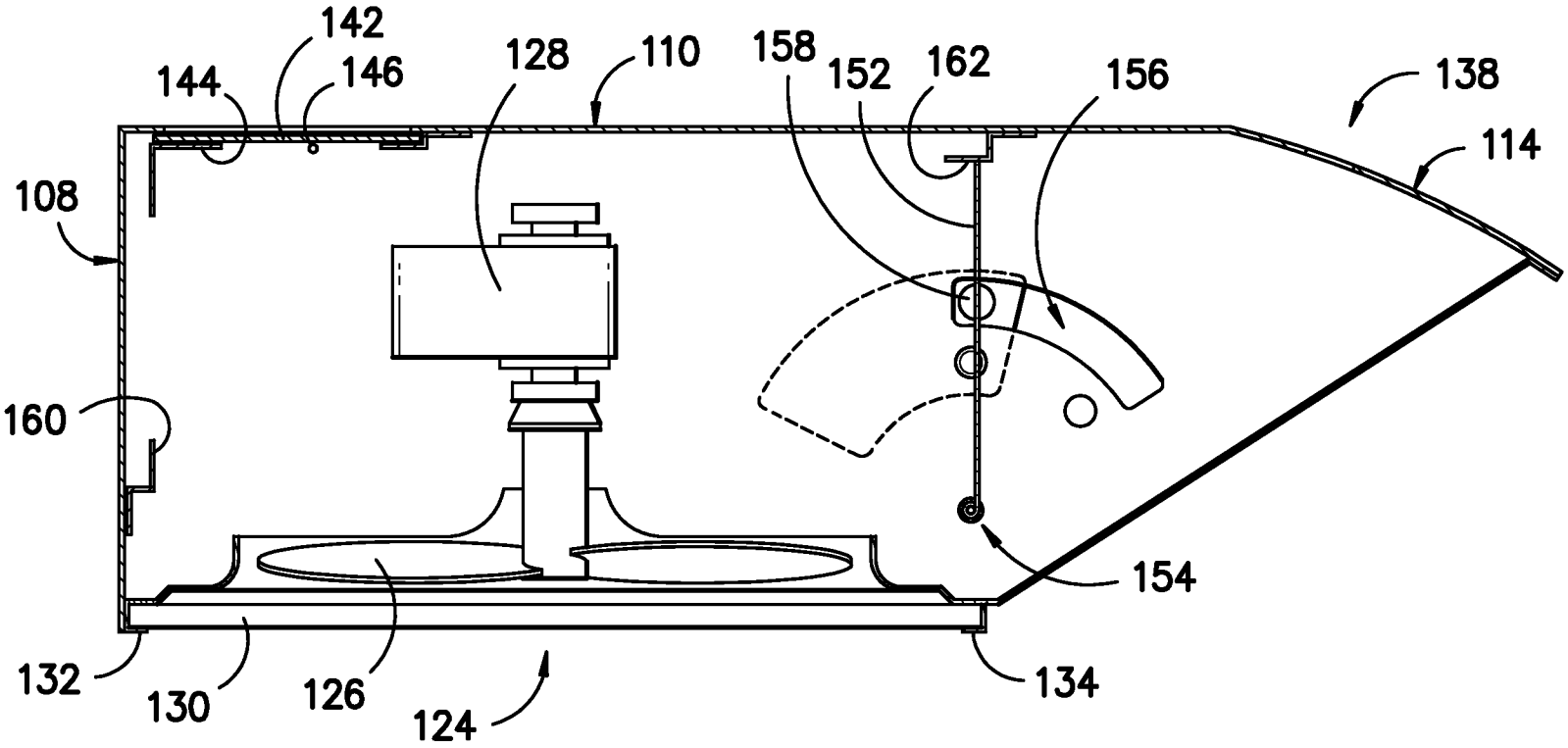
FIG. 4 is a side view of the exemplary range hood of FIG. 1 with a movable damper shown in the closed position.

Accordingly, movable plate 142 and damper 152 allow a user to readily select between two operating modes for range hood 100—namely a recirculation mode and an exterior venting mode. More specifically, by sliding plate 142 into the closed position as shown in FIG. 1 and rotating damper 152 to the open position as shown in FIG. 2, gas drawn into duct 118 by fan 126 is recirculated into the kitchen space through the second gas outlet 138 provided by the plurality of apertures 140 positioned on front panel 114. Conversely, by sliding plate 142 towards the open position as shown in FIG. 3 and rotating damper 152 into the closed position as shown in FIG. 4, gas drawn into duct 118 by fan 126 is vented to the exterior through first gas outlet 136 defined on the rear panel 108 of cabinet 102.

As stated, range hood 100 is installed over e.g., a range or cook top appliance. Typically, the first gas outlet 136 will be connected with additional duct work leading to the exterior i.e. atmosphere. However, the shape and location of such duct work can vary from kitchen to kitchen. Accordingly, range hood 100 can be provided with first gas outlet 136 in different shapes and locations on cabinet 102 so as to accommodate such differences.

Figure 5:
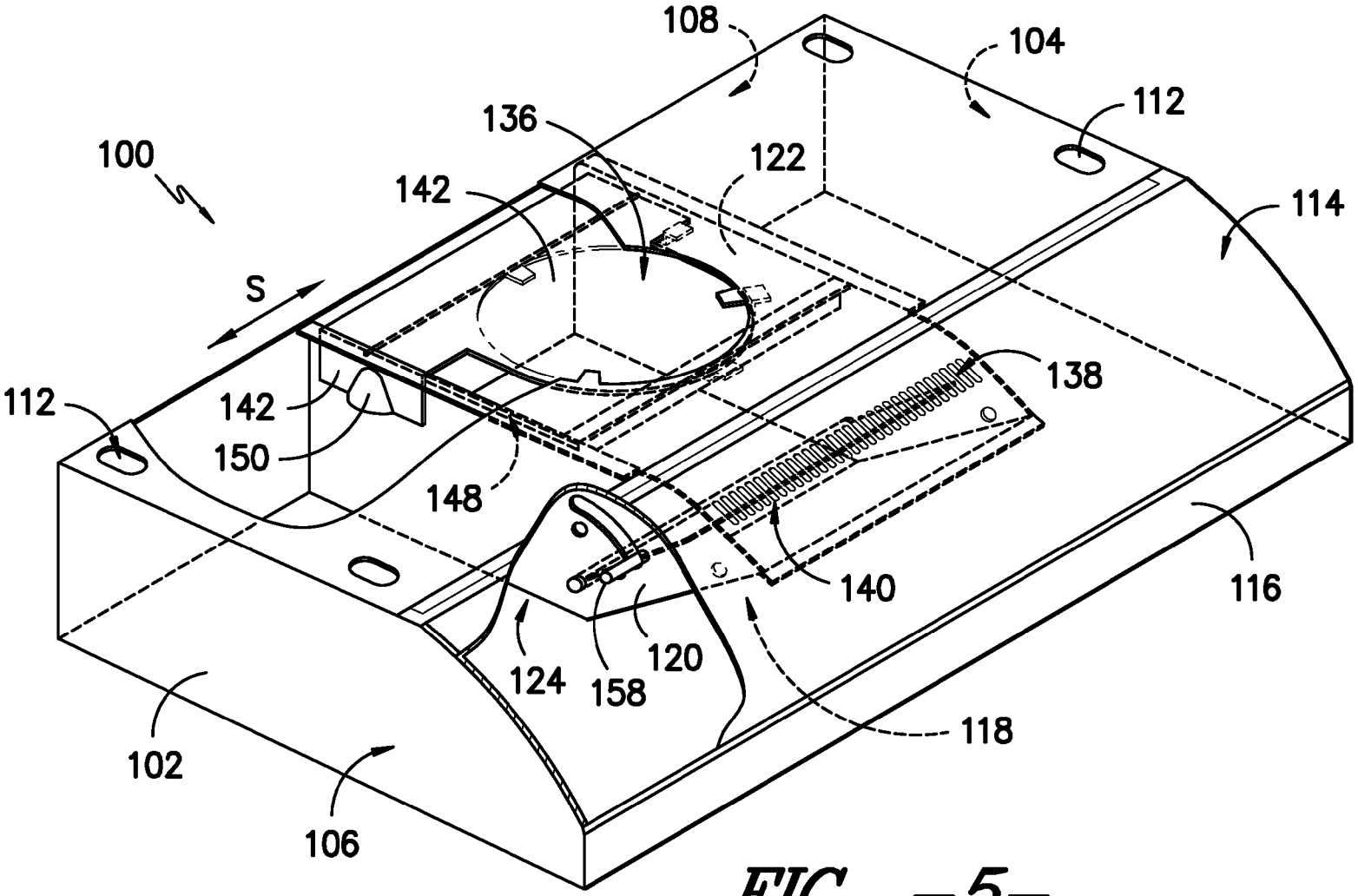
FIG. 5 provides a perspective and partial cross-sectional view of an exemplary embodiment of a range hood of the present invention with a first gas outlet closed.
Figure 6:
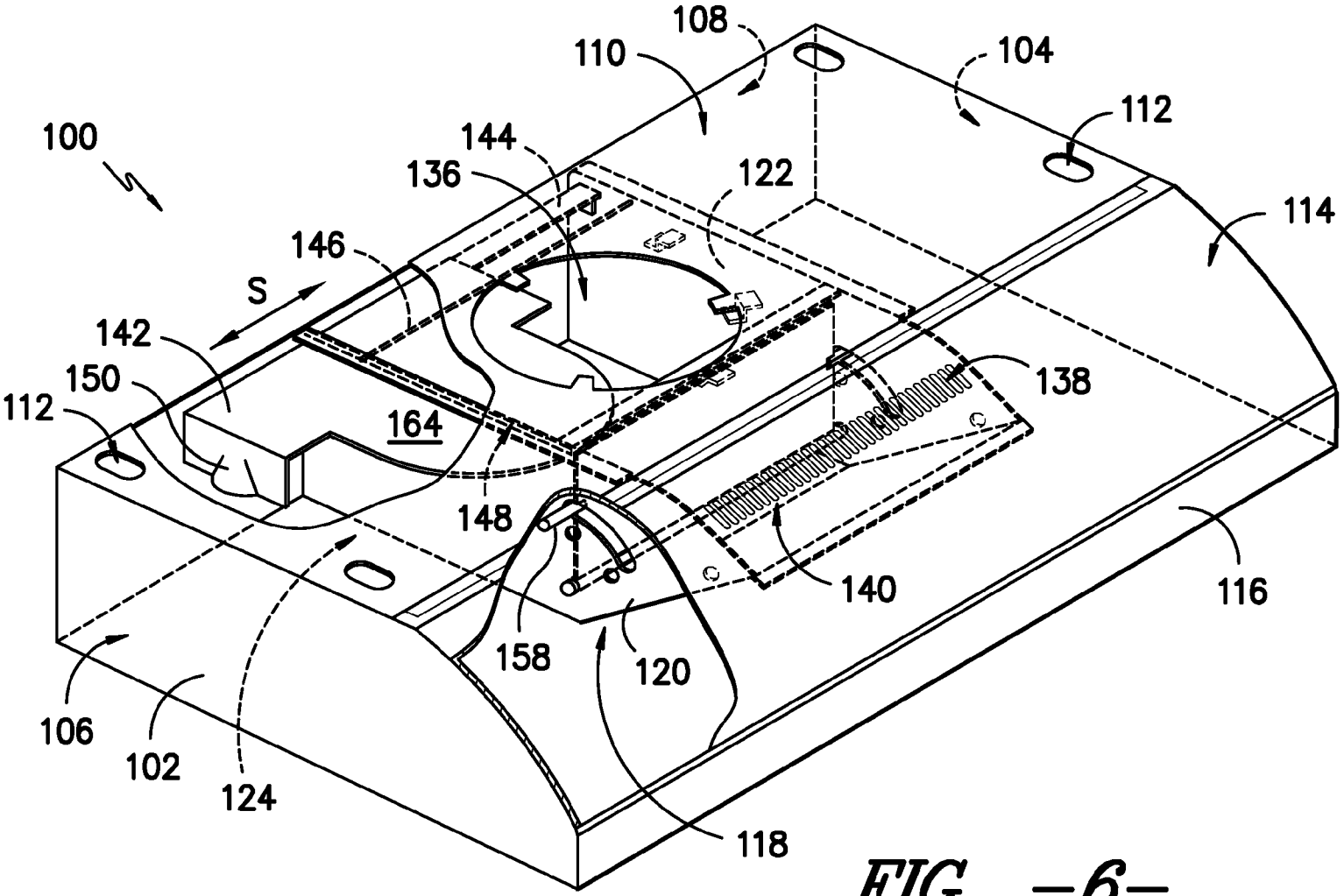
FIG. 6 is a perspective and partial cross-sectional view of the exemplary embodiment of a range hood of FIG. 5 with the first gas outlet open.

For example, referring now to FIGS. 5 and 6, top panel 110 defines a first gas outlet 136 that that is circular in shape and, like the embodiment of FIGS. 1 through 4, allows connection to duct work located above range hood 100. For this exemplary embodiment, movable plate 142 is partially rectangular—but also includes a circular portion for blocking first gas outlet 136. Movable plate 142 is supported and guide by first rail 144 and third rail 162 (FIG. 2) as it moves in and out of slot 148. Accordingly, in a manner similar to the exemplary embodiment of FIGS. 1-4, movable plate 142 can be slid along the directions of arrows S to either a closed position (FIG. 5) blocking the flow of gas through first gas outlet 136 or an open position (FIG. 6) allowing the flow of gas through first gas outlet 136. The user can then rotate damper 152 to an open position (FIG. 5) or closed position (FIG. 6) so as to select exterior venting or recirculation.

Figure 7:
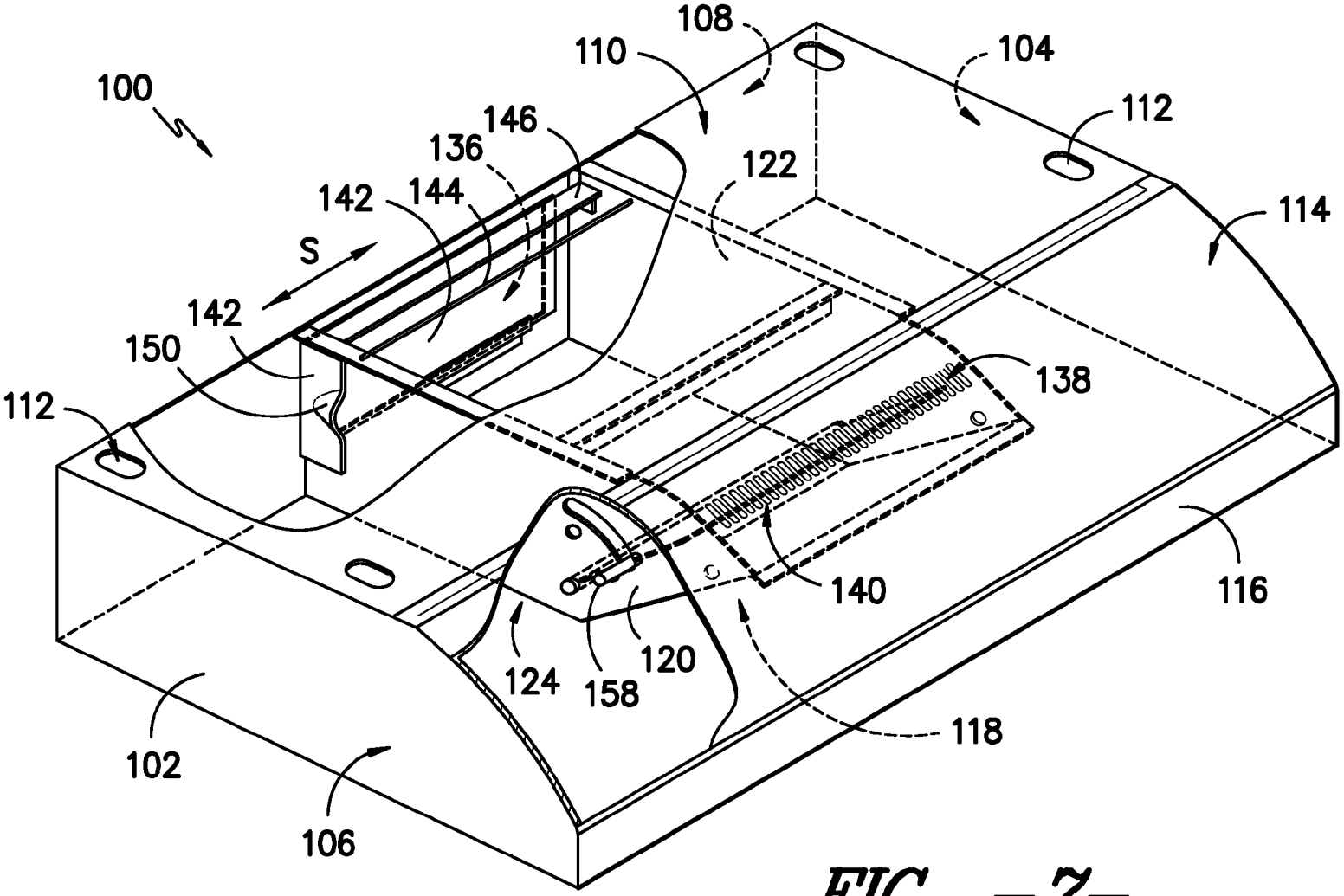
FIG. 7 provides a perspective and partial cross-sectional view of an exemplary embodiment of a range hood of the present invention with a first gas outlet closed.
Figure 8:
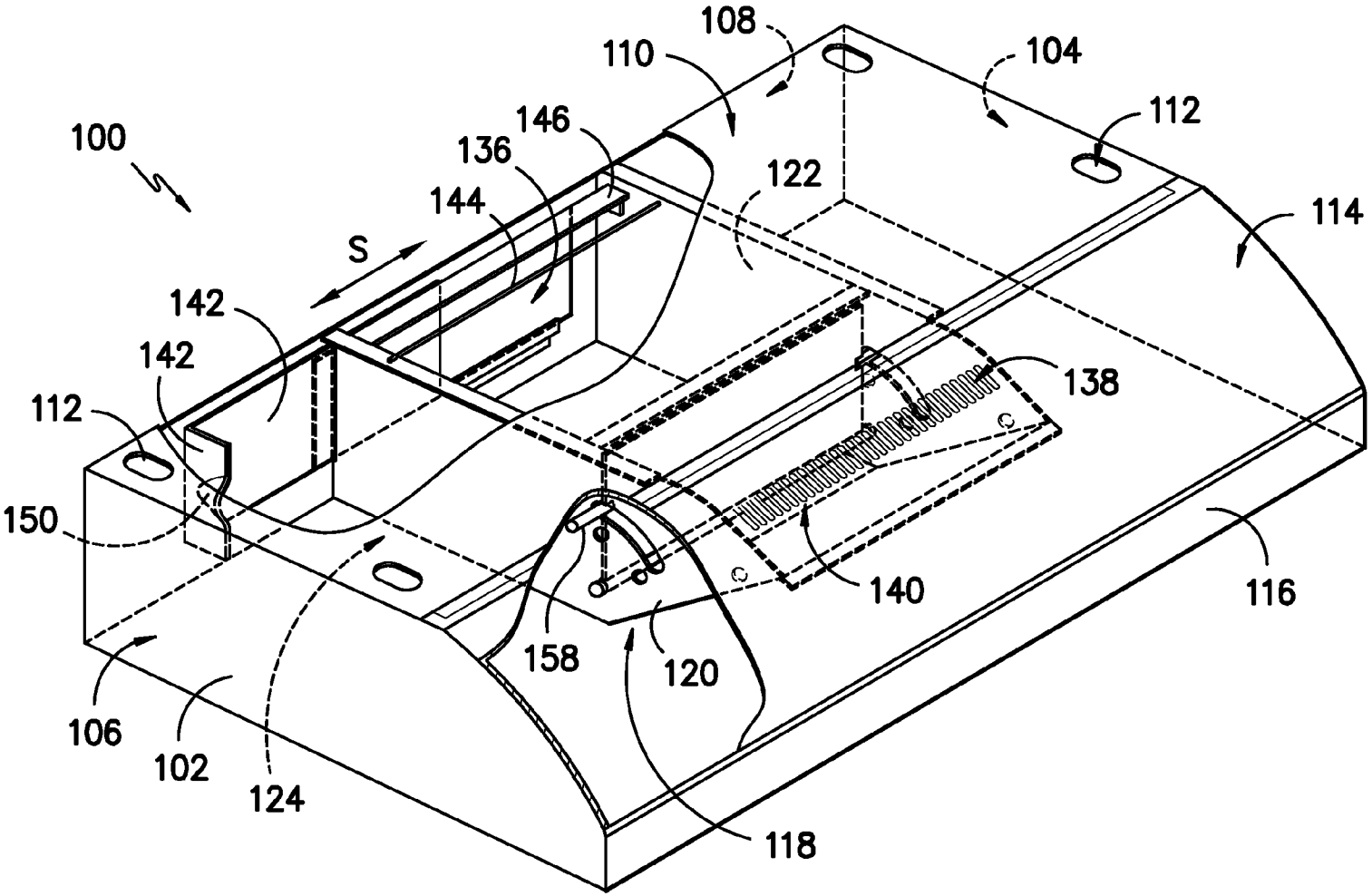
FIG. 8 is a perspective and partial cross-sectional view of the exemplary embodiment of a range hood of FIG. 7 with the first gas outlet open.

FIGS. 7 and 8 illustrates another exemplary embodiment of the present invention that allows for connection to duct work located to the rear of range hood 100. More particularly, for this exemplary embodiment, first gas outlet 136 is defined by rear panel 108 and is rectangular in shape. Movable plate 142 is also rectangular in shape and is supported and guided by first rail 144 and fourth rail 160 (FIG. 2) as it moves in and out of slot 148. Accordingly, in a manner similar to the previous exemplary embodiments, movable plate 142 can be slid along the directions of arrows S to either a closed position (FIG. 7) blocking the flow of gas through first gas outlet 136 or an open position (FIG. 8) allowing the flow of gas through first gas outlet 136. The user can then rotate damper 152 to an open position (FIG. 7) or closed position (FIG. 8) so as to select exterior venting or recirculation.

For each of the exemplary embodiments shown in FIGS. 1 through 8, the location of first gas outlet 136 can be provided as knockout portions defined in the panels of cabinet 102. For example, where cabinet 102 is made of sheet metal, score lines can be provided such that an installer of range hood 100 can readily remove a knock out portion where needed depending upon the geometry of the duct work with which range hood 100 will be installed. The manufacturer can provide multiple slidable plates 142 with range hood 100 so that the installer or user can select the plate having the appropriate shape depending upon the shape and location of the first gas outlet 136 provided by the removed knock out portion.

Different filter media for filter 130 may be desired depending upon whether exterior venting or recirculation mode is selected by a user of the appliance. Accordingly, as shown in FIG. 9, filter 130 can be provided with two portions created by a first filter media 164 and a second filter media 166. For example, first filter media 164 might be a wire mesh that is used when range hood 100 is venting to the exterior, and second filter media 166 might be a charcoal filter that is used when range hood 100 is in recirculation mode. Returning now to FIG. 2, by sliding filter 130 along guides 132 and 134, the user can readily position the desired filter media in front of gas inlet 124 depending upon which mode of operation is selected. In either case, fan 126 will pull air through the filter media to provide the filtering desired.

For the exemplary embodiment shown in the figures, damper 152 is configured as rotatable or pivotable about point 154. However, as will be understood using the teachings disclosed herein, damper 152 could also have other configurations including e.g., a plate that slides back and forth in duct 118 in a manner similar to plate 142. Other configurations may be used as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A range hood appliance comprising:

a cabinet;

a duct connected with said cabinet, said duct comprising:

a gas inlet for the receipt of gas from a cooking space, a first gas outlet for directing gas to an exterior of the cooking space; and, a second gas outlet for recirculating gas to the cooking space;

a fan for moving gas through said duct;

a slidable plate positioned at the first gas outlet, said slidable plate configured for sliding along said cabinet into and out of said duct between a closed position blocking the flow of gas from exiting through the first gas outlet and an open position adjacent to the first gas outlet that allows the flow of gas through the first gas outlet; and, a movable damper positioned within said duct, said damper movable between a closed position blocking the flow of gas through the second gas outlet and an open position that allows the flow of gas through the second gas outlet;

a filter positioned adjacent to the gas inlet, Said filter including a mesh portion and a charcoal portion, wherein said filter is slidable between positions where either the mesh portion only or the charcoal portion only can be located at the gas inlet so as to allow the selective use of either to filter the gas entering said duct.

2. A range hood appliance as in claim 1, wherein said movable damper is rotatable between the closed position blocking the flow of gas through the second gas outlet and the open position that allows the flow of gas through the second gas outlet.

3. A range hood appliance as in claim 2, wherein said duct defines an aperture positioned adjacent to said movable damper, and further comprising a handle extending from said aperture whereby a user may selectively position said damper between the closed position blocking the flow of gas through the second gas outlet and the open position that allows the flow of as through the second gas outlet.

4. A range hood appliance as in claim 1, wherein said duct defines a slot through which said slidable plate may be inserted into, or withdrawn from, said duct by a user of the appliance so as to slide said slidable plate between the closed position blocking the flow of gas from exiting through the first gas outlet and the open position adjacent to the first gas outlet that allows the flow of gas through the first gas outlet.

5. A range hood appliance as in claim 1, wherein said cabinet has a top panel and a rear panel, and wherein said first gas outlet is positioned on either the top panel or the rear panel.

6. A range hood appliance as in claim 5, wherein said cabinet comprises knockout portions in the top panel and the rear panel configured for removal so as to create said first gas outlet.

7. A range hood appliance as in claim 1, wherein said cabinet comprises a rail for guiding the movement of said slidable plate; and said slidable plate is disposed at least partially within said cabinet.

8. A range hood appliance as in claim 1, wherein said cabinet further comprises a first rail positioned along a rear panel of said cabinet and configured for guiding the movement of said slidable plate; and, a second rail positioned along a top panel of said cabinet adjacent to the first gas outlet and also configured for guiding the movement of said slidable plate.

9. A range hood appliance as in claim 1, wherein said fan is positioned adjacent to the gas inlet.

10. A range hood appliance as in claim 1, further comprising a filter positioned adjacent to the gas inlet.

11. A range hood appliance as in claim 1, further comprising:

a filter positioned adjacent to the gas inlet, said filter including a mesh portion and a charcoal portion, wherein said filter is slidable along said cabinet between positions where either the mesh portion or the charcoal portion can be positioned at the gas inlet so as to allow the selective use of either to filter the gas entering said duct.

12. A range hood appliance as in claim 1, wherein the second gas outlet comprises one or more apertures positioned along a top panel of said cabinet.

13. A range hood appliance, comprising an enclosure that comprises a top panel extending between two side panels and a rear panel also extending between the two side panels;

a duct defined at least partially within said enclosure, said duct connecting a gas inlet, a first gas outlet leading to an exterior of a kitchen space, and a second gas outlet leading to a kitchen space;

a blower positioned at the gas inlet for drawing gas into the duct from the kitchen space;

a gas flow controller positioned within the duct and configured for selectively allowing or blocking the flow of gas from the duct to the second gas outlet;

a movable gate positioned at the first gas outlet, said movable gate configured for selective movement into and out of said duct between a closed position that blocks the flow of gas from said duct through the first gas outlet and an open position that allows the flow of gas through the first gas outlet; and a filter positioned adjacent to the gas inlet, said filter including a mesh portion and a charcoal portion, wherein said filter is slidable between positions where either the mesh portion only or the charcoal portion only can be located at the gas inlet so as, to allow the selective use of either to filter the gas entering said duct.

14. A range hood appliance as in claim 13, wherein said gas flow controller is rotatable between the closed position and the open position.

15. A range hood appliance as in claim 13, wherein said movable gate is slidable between the closed position and the open position.

16. A range hood appliance as in claim 14, further comprising one or more tracks positioned at the first gas outlet and configured for supporting and guiding the movement of said movable gate.

17. A range hood appliance as in claim 16, further comprising a slot positioned adjacent to the first gas outlet and through which said movable gate is inserted into the closed position or removed into the open position.

18. A range hood appliance as in claim 16, further comprising a filter positioned adjacent to the gas inlet.

19. A range hood appliance, comprising:

a cabinet having a front panel, a rear panel, and a top panel extending between side panels;

a duct positioned in said cabinet and defined by the top and rear panels of the cabinet and opposing side walls, said duct comprising:

a gas inlet for the receipt of gas from a cooking space, a first gas outlet for directing gas to an exterior of the cooking space, a second gas outlet for recirculating gas to the cooking space, and a slot defined in one of the opposing side walls;

a fan positioned in said duet for moving gas through said duct;

a slidable plate positioned at the first gas outlet, said slidable configured for sliding through said slot into said duct to block the flow of gas from exiting through the first gas outlet and out of said duct to allow the flow of gas through the first gas outlet;

a movable damper positioned within said duct, said damper movable between a closed position blocking the flow of gas through the second gas outlet and an open position that allows the flow of gas through the second gas outlet; and a liter positioned adjacent to the gas inlet, said filter including a mesh portion and a charcoal portion, wherein said filter is slidable between positions where either the mesh portion only or the charcoal portion only can be located at the gas inlet so as to allow the selective use of either to filter the as entering said duct.

* * * * *